US005444181A

United States Patent [19]

Wada et al.

[11] Patent Number: 5,444,181

[45] Date of Patent: Aug. 22, 1995

[54] KEYBOARD INSTRUMENT SELECTIVELY ENTERING INTO AN ACOUSTIC SOUND MODE AND AN ELECTRONIC SOUND MODE THROUGH A ROTATION OF A STOPPER WITH A CUSHION SHEET AGAINST DAMPER WIRES

[75] Inventors: Masahiro Wada; Tatsuya Makino, both of Shizuoka, Japan

[73] Assignee: Yamaha Corporation, Japan

[21] Appl. No.: 215,913

[22] Filed: Mar. 22, 1994

[30] Foreign Application Priority Data

Mar. 24, 1993 [JP] Japan ..... 5-090880

[51] Int. Cl.[6] ..... G10C 5/00; G10D 15/00; G10H 1/34

[52] U.S. Cl. ..... 84/719; 84/2; 84/3; 84/171; 84/236

[58] Field of Search ..... 84/719, 720, 2, 3, 12–23, 84/170–172, 236–240, 423 R, 433, DIG. 7

[56] References Cited

U.S. PATENT DOCUMENTS

| | | | |
|---|---|---|---|
| 533,661 | 2/1894 | McChesney et al. . | |
| 537,533 | 10/1894 | McChesney et al. . | |
| 2,250,065 | 7/1941 | Koel | 84/171 |
| 4,633,753 | 1/1987 | Takahashi | 84/220 |
| 4,704,931 | 11/1987 | Nagai | 84/1.01 |
| 4,744,281 | 3/1987 | Isozaki | 84/1.28 |
| 4,970,929 | 11/1990 | Ishida | 84/120 |
| 5,001,339 | 3/1991 | Starkley et al. | 250/229 |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| TO91U0077 | 10/1992 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |
| 3-246597 | 11/1991 | Japan . |

*Primary Examiner*—Stanley J. Witkowski
*Attorney, Agent, or Firm*—Graham & James

[57] ABSTRACT

A keyboard instrument selectively enters into an acoustic sound mode for performing a music with acoustic piano sounds and an electronic sound mode for performing a music with synthetic sounds, and a rotary stopper is provided between hammer shanks and strings for interrupting a rotation of the hammer toward the strings in the electronic sound mode; wherein a cushion is provided on the rotary stopper for damping an impact of a damper leaving from the strings in both acoustic and electronic sound modes so that a player can perform a music without a noise.

8 Claims, 6 Drawing Sheets

KEYBOARD INSTRUMENT SELECTIVELY ENTERING INTO AN ACOUSTIC SOUND MODE AND AN ELECTRONIC SOUND MODE THROUGH A ROTATION OF A STOPPER WITH A CUSHION SHEET AGAINST DAMPER WIRES

FIELD OF THE INVENTION

This invention relates to a keyboard instrument and, more particularly, to a keyboard instrument selectively entering into an acoustic sound mode and an electronic sound mode through a rotation of a stopper.

DESCRIPTION OF THE RELATED ART

A typical example of a muffler incorporated in the acoustic piano is disclosed in Japanese Utility Model Publication of Unexamined Application (Kokai) No. 51-67732. According to the Japanese Utility Model Publication, if a player manipulates the muffler, the hammer concurrently strikes the associated strings and the muffler, and the strings faintly vibrate for producing an acoustic tone. As a result, the player performs a music with soft tones, because the muffler decreases the volume of the acoustic tones.

However, the muffler disclosed in the Japanese Utility Model Publication does not allow a player to perform a music in perfectly silent environment.

Shank stoppers were proposed in Japanese Patent Application No. 4-174813 filed on Jun. 9, 1992 which formed a part of U.S. patent application Ser. No. 08/073,092 and European Patent Application No. 93109211.8. The Japanese Patent Application was not published on the priority date of the present application. The shank stoppers cause hammer shanks to rebound thereon before strikes against strings, and keep the strings silent in a silent mode. One of the shank stoppers has cushion members opposed to the damper wires in the silent mode. In this instance, when a player depresses a key in the silent mode, the associated hammer assembly is restricted by the shank stopper on the way toward the strings, and the damper wire is brought into contact with the cushion member. For this reason, not only the impact of the hammer shank but also the impact of the damper wire are extinguished in the silent mode, and the player can practice a fingering on the keyboard in perfectly silent environment.

However, the shank stopper does not guarantee the noiseless action of the damper wire in an acoustic sound mode or a mechanically sound producing mode. In the acoustic sound mode, the hammer heads strike the strings, and the strings vibrate for producing piano tones. Even if the damper wires hit the shank stopper, the noise is faint, and is liable to be drowned in the piano tones. However, a player of a nervous temperament hates the noise in pianissimo tones.

SUMMARY OF THE INVENTION

It is therefore an important object of the present invention to provide a keyboard instrument which prevents a music from a noise due to an impact of a damper wire in both acoustic sound and silent modes.

To accomplish the object, the present invention proposes to provide a cushion on a shank stopper such that a damper wire is brought into contact in both acoustic and electronic sound modes In accordance with the present invention, there is provided a keyboard instrument having at least an acoustic sound mode for producing acoustic sounds and an electronic sound mode for producing synthetic sounds, comprising: a ) an acoustic piano having a-1) a keyboard implemented by a plurality of swingable keys depressed by a player in both acoustic sound and electronic sound modes, notes of a scale being assigned to the plurality of swingable keys, a-2) a plurality of key action mechanisms respectively linked with the plurality of swingable keys, and selectively actuated by depressed keys of the keyboard in both acoustic sound and electronic sound modes, a-3) a plurality of hammer assemblies respectively associated with the plurality of key action mechanisms, and selectively driven for rotation by actuated key action mechanisms linked with the depressed keys in both acoustic sound and electronic sound modes, the actuated key action mechanisms and the associated hammer assemblies producing a piano key-touch in both acoustic sound and electronic sound modes, a-4) a plurality of string means respectively associated with the plurality of hammer assemblies, and selectively struck by hammer assemblies driven by the actuated key action mechanisms in the acoustic sound mode for producing the acoustic sounds, and a-5) a plurality of damper mechanisms respectively associated with the plurality of string means for damping vibrations thereon, and driven by the depressed keys for leaving from the associated string means, thereby allowing the associated string means to vibrate; b) an electronic sound generating system enabled in the electronic sound mode for producing synthetic sounds having notes identified by the depressed keys; and c) a mode controlling system having c-1) a rotatable stopper means provided between the plurality of key action mechanisms and the plurality of string means, and angularly movable between a blocking position and a free position, c-2) a driving means associated with the rotatable stopper means for changing the stopper means between the free position and the blocking position, the hammer assemblies striking the string means without an interruption of the stopper means in the free position, the hammer assemblies being brought into contact with the stopper means in the blocking position without a strike against the string means, and c-3) a cushion means provided on the rotatable stopper means, and opposite to the plurality of damper mechanisms in both acoustic and electronic sound modes, thereby decreasing impact of damper mechanisms associated with the depressed keys against the rotatable stopper means.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS

First Embodiment

Figure 1:
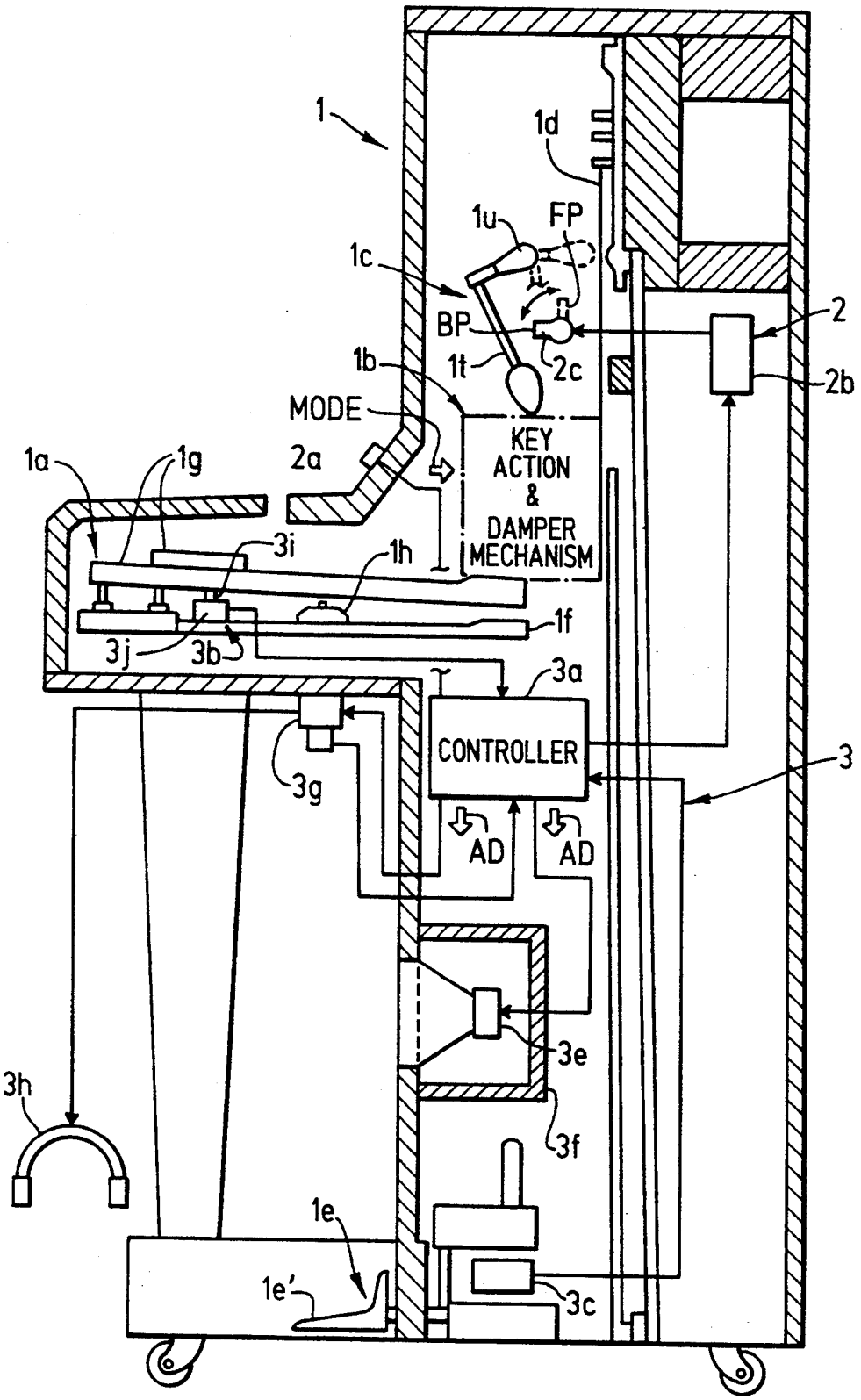
FIG. 1 is a cross sectional side view showing the structure of a keyboard instrument according to the present invention.

Referring first to FIG. 1 of the drawings, a keyboard instrument embodying the present invention largely comprises an acoustic piano 1, a mode controlling system 2 and an electronic sound generating system 3, and selectively enters an acoustic sound mode for acoustic piano sounds and an electronic sound mode for synthetic sounds. While the keyboard instrument is staying in the acoustic sound mode, the keyboard instrument serves as an acoustic upright piano, and a player can perform a music with the acoustic piano sounds. On the other hand, when the player switches the keyboard instrument to the electric sound mode, the electronic sound generating system 3 synthesizes an audio signal AD, and produces the synthetic sounds with the notes identified by depressed keys. However, the keyboard instrument does not produce the acoustic sounds. The electronic sound generating system 3 usually imparts the same timbre as the acoustic piano sounds to the synthetic sounds. However, the player can impart other timbre to the synthetic sounds. In this instance, the acoustic piano 1 is of the upright type. However, the acoustic piano 1 may be of a grand type.

In the following description, "clockwise" and "counter clockwise" are determined in a figure where a member to be rotated is illustrated, and "front" is closer to a player in front of a keyboard than "rear".

The acoustic piano 1 largely comprises a keyboard 1*a*, a plurality of key action/damper mechanisms 1*b*, a plurality of hammer mechanisms 1*c*, a plurality sets of strings 1*d* and a pedant mechanism 1*e*. The keyboard 1*a* is mounted on a key bed structure 1*f*, and is implemented by eighty-eight black and white keys 1*g*. The black and white keys 1*g* are turnable with respect to balance pins embedded in a balance rail 1*h*. The key action/damper mechanisms 1*b* are respectively linked with the rear ends of the black and white keys 1*g*, and are allows the hammer mechanisms 1*c* to strike the associated strings 1*d* in the acoustic sound mode. However, the mode controlling system 2 interrupts the hammer assemblies 1*c* in the electronic sound mode before striking the strings 1*d*.

Figure 2:
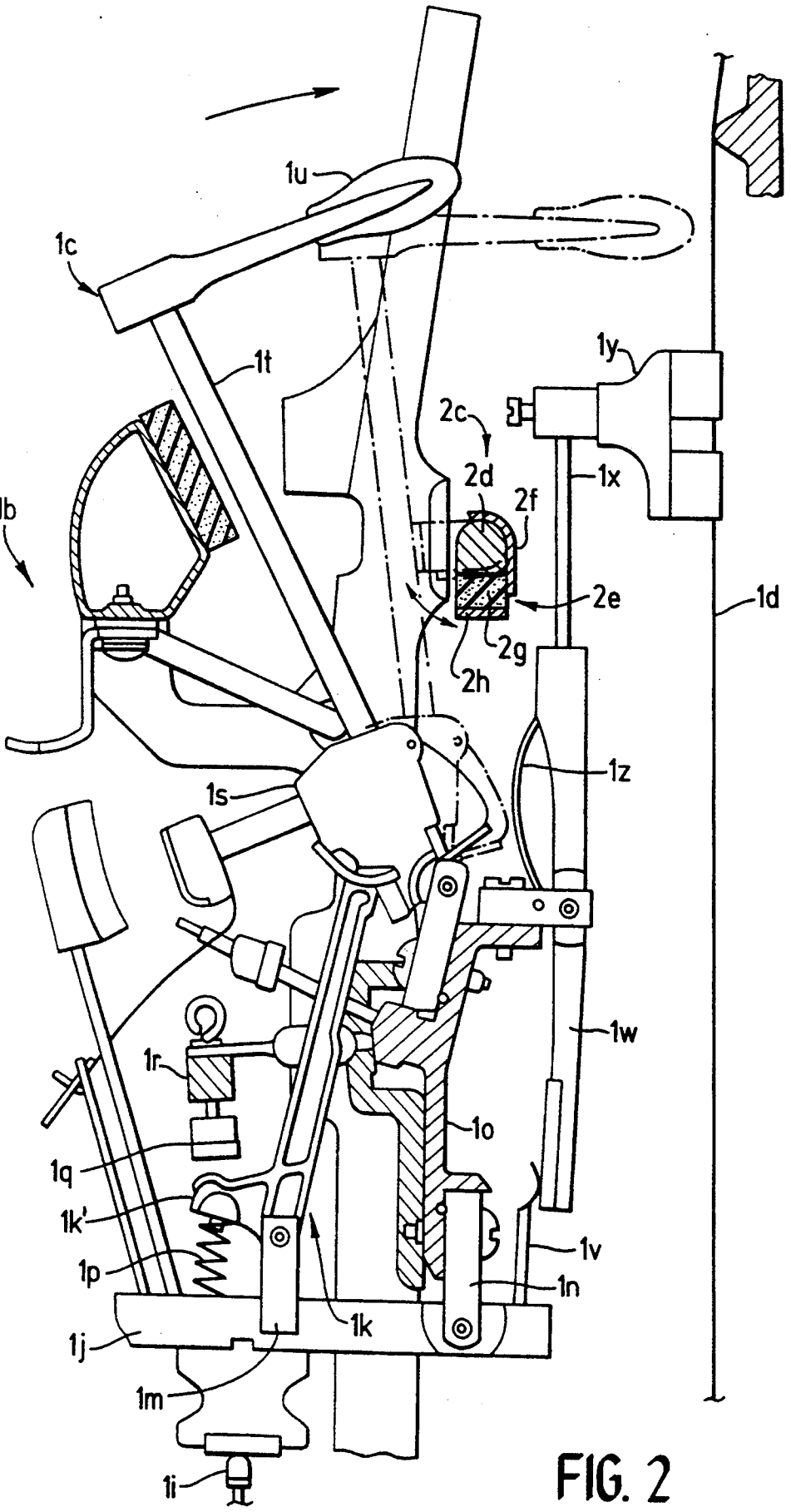
FIG. 2 is a cross sectional side view showing the arrangement of a key action/damper mechanism incorporated into the keyboard instrument.

Turning to FIG. 2 of the drawings, each of the key action/damper mechanisms 1*b* is broken down into a key action sub-mechanism and a damper sub-mechanism, and the key action sub-mechanism comprises a capstan screw 1*i* projecting from the rear end of the associated key 1*g*, an whippen assembly 1*j* held in contact with the capstan screw 1*i* and a jack 1*k* turnably supported by a jack flange 1*m* on the whippen assembly 1*j*. The whippen assembly 1*j* is turnably supported by a whippen flange In which in turn is supported by a center rail lo. A jack spring 1*p* is interposed between a the 1*k'* of the jack 1*k* and the whippen assembly 1*j*, and urges the jack in the clockwise direction around the jack flange 1*m*.

The key action mechanism 1*b* further comprises a plurality of regulating buttons 1*q* supported by the center rail 1*o* through a regulating rail 1*r*, and each of the regulating buttons 1*q* is opposed to the toe 1*k'* of the jack 1*k*. A gap between the regulating button 1*q* and the toe 1*k'* is regulable by rotating the regulating button 1*q*, and the gap may be changed between the acoustic sound mode and the electronic sound mode.

Each of the hammer mechanisms 1*c* comprises a butt 1*s* kicked by the jack 1*k*, a hammer shank It implanted in the butt 1*s* and a hammer 1*u* connected with the leading end of the hammer shank 1*t*, and the hammer 1*u* strikes the associated set of strings 1*d*. Although a catcher and a back check are illustrated in FIG. 2, a person skilled in the art knows the function thereof, and no further description is incorporated hereinbelow.

The damper sub-mechanism comprises a damper spoon 1*v* projecting from the whippen assembly 1*j* on the opposite side of the jack flange 1*m* with respect to the whippen flange 1*n*, a damper lever 1*w* rotatably supported by the center rail lo through a damper lever flange, a damper wire 1*x* implanted into the damper lever 1*w*, a damper head 1*y* supported by the damper wire 1*x*, and a damper spring 1*z* urging the damper lever 1*w* in the clock wise direction. While the associated key 1*g* is remaining in a rest position, the damper spring 1*z* urges the damper lever 1*w* so that the lower end position of the damper lever 1*w* and the damper head 1*y* are held in contact with the damper spoon 1*v* and the associated set of strings 1*d*. However, a damper stop rail is not incorporated in the key action/damper mechanism 1*b*, because the stopper 2*c* receives the damper wires 1*x*. For this reason, the stopper 2*c* does not make the keyboard instrument complex.

Turning back to FIG. 1, the pedal mechanism 1*e* usually have three pedals and three pedal link sub-mechanisms respectively associated with the pedals. One of the pedal is called as a damper pedal 1*e'* and allows the strings to prolong the acoustic sound. The second pedal is called as a soft pedal, and causes the hammers to strike fewer than the normal number of strings for lessening the volume. The last pedal, is called as a sostenuto pedal, and enables selected notes to be sustained independently from the others.

The controlling system 2 comprises a mode shift switch 2*a*, a motor driver unit 2*b* and a rotatable stopper 2*c*. The mode shift switch 2*a* is manipulated by a player, and produces an instruction signal MODE indicative of either acoustic or electronic sound mode. The sound processing unit 3*a* periodically checks an input port assigned to the instruction signal MODE to see whether or not the player changes the operation mode. While the keyboard instrument is staying in the acoustic sound mode, the motor driver unit 2*b* keeps the stopper 2*c* in a free position FP where the hammer lo can strike the associated strings 1*d* without interruption of the stopper 2*c*. On the other hand, if the instruction signal MODE is indicative of the electronic sound mode, the motor driver 2*b* causes an electric motor (not known) to change the stopper 2*c* from the free position FP to a blocking position BP, and the hammer shanks 1*t* rebounds on the stopper 2*c* before striking the strings 1*d*.

As will be better seen from FIG. 2 of the drawings, the stopper 2*c* comprises a shaft 2*d* of stainless steel driven for rotation by the electric motor (not shown), a first cushion member 2*e* attached to the outer peripheral surface of the shaft 2*d* for the hammer shanks It and a second cushion member 2*f* for the damper wires 1*x*. In this instance, the first cushion member 2*e* is implemented by a cushion layer 2*g* of artificial leather or felt and a protective layer 2*h* of artificial leather, and the protective layer 2*h* is opposed to the hammer shanks 1*t* in the blocking position BP. However, the protective layer 2*h* is directed toward the butt 1*s* in the free position FP, and the gap between the hammer shanks It and a side surface of the first cushion member is decreased rather than the gap between the protective layer 2h and the hammer shanks 1t in the blocking position BP.

On the other hand, the second cushion member 2f is formed of felt or cloth, and extends from a side surface of the first cushion member 2e to the outer peripheral surface 180 degrees spaced from the first cushion member 2e. Therefore, while the stopper 2c is in the free position FP as shown in FIG. 2, the damper wires 1x are opposed to the second cushion member 2f on the side surface of the first cushion member 2e. Even through the stopper 2c is changed to the blocking position BP, the damper wires 1x are opposed to the second cushion member 2e on the outer peripheral surface of the shaft 2d. Thus, the second cushion member 2f is opposable to the damper wires 1x at all times. The first cushion member 2e and the second cushion member 2f may be split into first cushion sub-members and second cushion sub-members.

The stopper 2c and the second cushion member 2f serves as a damper stop rail and a damper stop rail felt member, and make the keyboard instrument simple. Moreover, the second cushion member 2f damps the vibrations due to the impact between the hammer shanks 1t and the first cushion member 2e, and the repeated impacts hardly misalign the shaft member 2d and bearing units (not shown).

Turning back to FIG. I of the drawings, the electronic sound generating system 3 comprises a controller 3a, a plurality of key sensors 3b, a plurality of pedal sensors 3c, a speaker system 3e housed in a speaker box 3f, a socket unit 3g and a headphone 3h detachable from the socket unit 3g.

The plurality of key sensors 3b are respectively associated with the plurality of keys 1g, and each of the key sensors 3b comprises a shutter plate 3i fixed to the bottom surface of the associated key 1g and a photo-interrupter 3j for monitoring the shutter plate 3i. Four different slit patterns are formed in the shutter plate 3i, and the four slit patterns are respectively indicative of four positions of the .associated key 1g on the way from the rest position to the and position. If a player depresses one of the keys 1g, the shutter plate 3i sequentially passes through an optical path produced by the associated photo interrupter 3j. Time intervals between the four patterns are reported from the photo interrupter 3j to the sound processing unit 3a, and the controller 3a determines the locus of the depressed key and estimates an intensity of impact against the associated strings 1d and a timing for producing a synthetic sound.

The pedal sensors 3c monitor the three pedals to see whether or not the player steps on any one of the three pedals. If the player steps on one of the pedals, the pedal sensors 3c detect the motion of the pedal, and report the position of the pedal manipulated by the player to the controller 3a.

Figure 3:
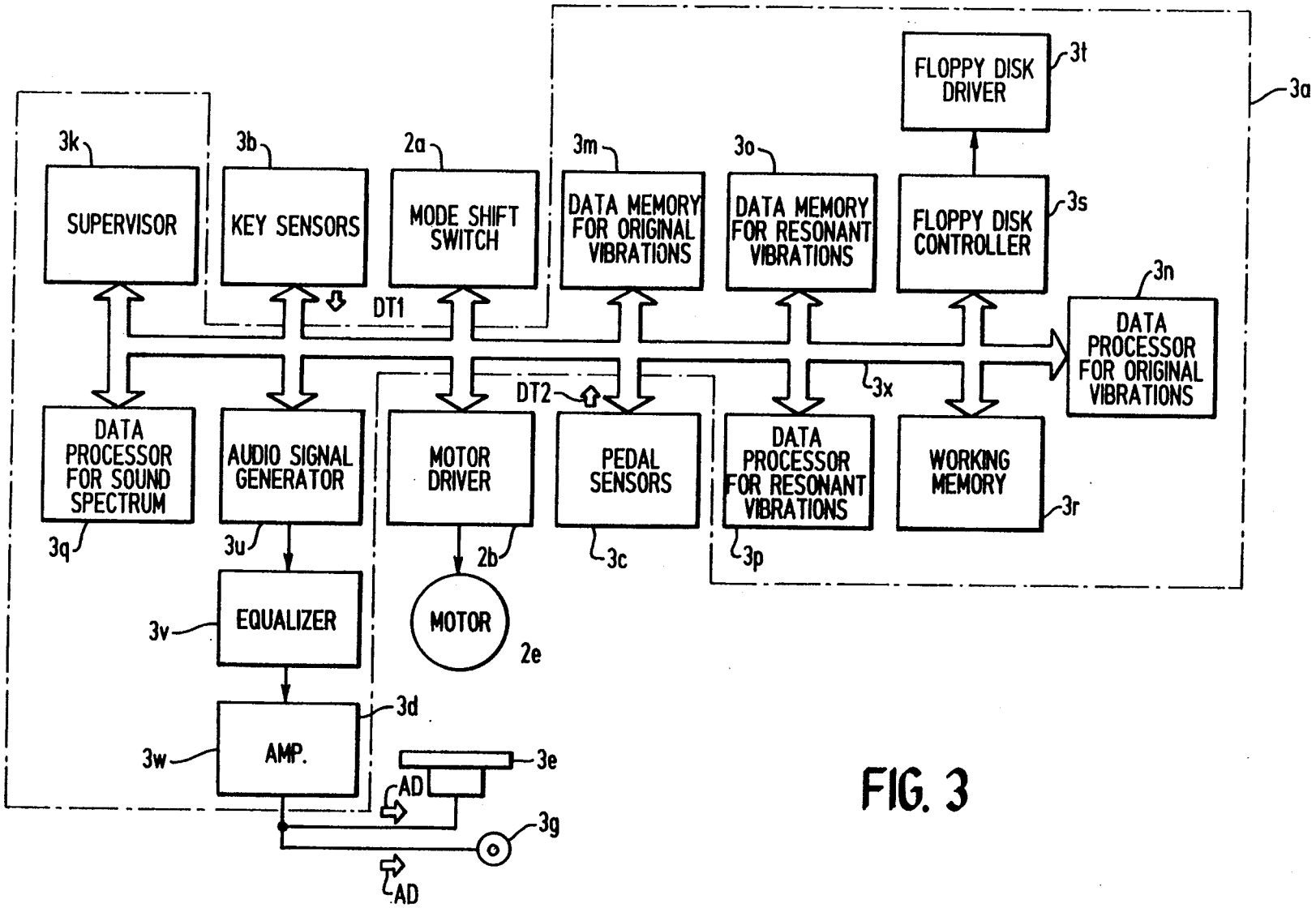
FIG. 3 is a block diagram showing the circuit arrangement of a controller incorporated in the keyboard instrument.

The controller 3a is arranged as shown in FIG. 3 of the drawings, and comprises a supervisor 3k, a data memory 3m for original vibrations, a data processor 3n for original vibrations, a data memory 3o for resonant vibrations, a data processor 3p for resonant vibrations, a data processor 3q for sound spectrum, a working memory 3r, a floppy disk controller 3s, a floppy disk driver 3t, an audio signal generator 3u, an equalizer 3v, an amplifier 3w and a bus system 3x. The controller 3a not only gives an instruction for a selected operation mode to the motor driver 2b but also produces an audio signal AD on the basis of the detecting signals DT1 from the key sensors 3b and the detecting signals DT2 from the pedal sensors 3c.

The supervisor 3k sequentially scans signal input ports assigned to the instruction signal MODE, the detecting signals DT1 from the key sensors 2b and the detecting signals DT2 from the pedal sensors 2c, and supervises the other components 3m to 3u for producing the audio signal AD. An internal table is incorporated in the supervisor 3k, and the internal table defines relation between the key numbers assigned to the eighty-eight keys 1g, the key velocities of the respective keys 1g and timings for producing the audio signal. The audio signal AD is supplied from the equalizer 3v to the amplifier unit 3w, and the audio signal AD is selectively distributed to the speaker system 3e and the socket unit 3g for producing synthetic sounds. Various internal registers are incorporated in the supervisor 3k, and one of the internal registers is assigned to a mode flag indicative of the mode of operation selected by the player.

The data memory 3m for original vibrations stores a plurality sets of pcm (Pulse Code Modulation ) data codes indicative of frequency specular of original vibrations on the strings 1d, and the plurality sets of pcm data codes are respectively corresponding to the keys 1g. A plurality groups of pcm data codes form a set of pcm data codes, and are corresponding to frequency specular at different intensities of impact or hammer speeds. If a hammer 1u strongly strikes the associated strings 1d, higher harmonics are emphasized, and a group of pcm data codes is selected from the associated set of pcm data codes on the basis of the estimated intensity of impact.

The plurality sets of pcm data codes are produced with a sampler (not shown), and the sampler samples actual vibrations on the respective strings 1d at an appropriate frequency. However, the set of pcm data codes may be produced by means of the data processor 3q through a real-time manner. Using a group of pcm data codes, original vibrations produced upon a strike against the strings 1d are restored, and the supervisor 3k controls the sequential access to a selected group of pcm data codes stored in the data memory 3m.

The data processor 3n for original vibrations is provided in association with the data memory 3m, and modifies a group of pcm data codes for an intermediate hammer speed. The modification with the data processor 3n is also controlled by the supervisor 3k.

The data memory 3o for resonant vibrations stores a plurality sets of pcm data codes indicative of resonant vibrations, and the resonant vibrations take place under step-on damper pedal 1e'. While a player is stepping on the damper pedal 1e' in the acoustic sound mode, the dampers 1y are held off, and some of the strings 1d are resonant with the string struck by the associated hammer 1u. The resonant tones range −10 dB and −20 dB with respect to the acoustic tone originally produced through the vibrations of the strings 1d, and time delay of several milliseconds to hundreds milliseconds is introduced between the acoustic tone originally produced and the resonant tones. If the player continuously steps on the damper pedal, the resonant tones continues several seconds. On the other hand, the player can rapidly terminate the original and resonant tones by releasing the damper pedal 1e', and the audio signal generator 3u is responsive to the detecting signal DT2 of the pedal sensors 2c indicative of the rapid release. The pcm data codes stored in the data memory 3o are indicative of frequency specular of the resonant vibrations, and are also produced by means of the sampler or the data processor 3*q* for resonant vibrations. Each of the plurality sets of pcm data codes stored in the data memory 3*o* is corresponding to one of the depressed keys 1*g*, and is constituted by six groups of pcm data codes at the maximum. Each group of pcm data codes is corresponding to one of the resonant strings 1*d*, and the second harmonic to the sixth harmonic are taken into account for the strings 1*d* one octave higher than low-pitched sounds. However, if the depressed key is lower than the thirteenth key from the lowest key in the eighty-eight keys 1*g*, the strings 1*d* one octave lower than the depressed key should be taken into account. In general, seventy-one dampers are incorporated in a piano. However, another piano may have sixty-six dampers or sixty-nine dampers. As described hereinbefore, the intensity of frequency spectrum is corresponding to the hammer speed or the intensity of impact, and the intensities are variable with the type and model of the piano.

A set of pcm data codes are sequentially read out from the data memory 3*o* depending upon the depressed key 1*g* under the control of the supervisor 3*k*, and the data processor 3*p* for resonant vibrations can modify the pcm data codes for an immediate intensity. The memory capacity of the data memory 3*o* may be large enough to store the pcm data codes at all of the detectable hammer speeds, and the data processor 3*p* may calculate each set of pcm data codes on the basis of parameters stored in the data memory 3*o*.

The data processor 3*q* for sound spectrum can produce a group of pcm data codes indicative of frequency spectrum for original vibrations and a set of pcm data codes indicative of frequency :specular for resonant vibrations as described hereinbefore. The data processor 3*q* is further operative to cause the frequency specular to decay.

In detail, when a player releases a key, original vibrations on a string rapidly decays, because an associated damper is brought into contact with the string. The data processor 3*q* simulates the decay, and sequentially decreases the values of the pcm data codes. The resonant tones continue for several seconds in so far as the player keeps the damper pedal 1*e*′ in the depressed state. If, on the other hand, the player releases the damper pedal 1*e*′, the resonant tones are rapidly decayed. The data processor 3*q* also simulates the decay, and sequentially decreases the values of the pcm data codes for the resonant vibrations.

The decay is not constant. If the player releases the damper pedal through a half pedal position, the tones decay at lower speed rather than the ordinary release. Moreover, some players use the half pedal position in such a manner as to retard low-pitched tones rather than high-pitched tones, and such a pedal manipulation is called as an oblique contact. On the contrary, if the damper pedal causes all the dampers to be simultaneously brought into contact with the strings, the damper manipulation is referred to as simultaneous contact. The data processor 3*q* can simulate the gentle decay upon the release through the half pedal position as well as through the oblique contact, and the values of the pcm data codes are decreased at either high, standard or low speed in the simultaneous contact and at different speed in the oblique contact. The data processor 3*q* may change the ratio between the fundamental tone and the harmonics thereof for the half pedal position, and decay high-order harmonics faster than the fundamental tone. The frame of a piano usually vibrates, and the frame noises participate the piano sounds. The data processor 3*q* may take these secondary noises into account and modify the frequency ratio.

The audio signal generator 3*u* comprises a digital filter, a digital-to-analog converter and a low-pass filter, and produces an analog audio signal from the pcm data codes supplied from the data memories 3*m* and 3*o* and/or the data processors 3*n*, 3*p* and 3*q*. The pcm data codes are subjected to a digital filtering, and are, then, converted into the analog audio signal. In the digital filtering, the vibration characteristics of the speaker system 3*e* and vibration characteristics of the speaker box 3*f* are taken into account, and the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal AD, and the analog audio signal AD is filtered by the low-pass filter, and the low-pass filter is of a Butterworth type for improving group delay. The analog audio signal thus filtered is supplied through the equalizer 3*v* to the amplifier unit 3*d*, and the amplifier unit 3*d* amplifies the analog audio signal for driving the speaker system 3*e*.

The floppy disk driver 3*t* reads out data codes formatted in accordance with the MIDI standards from a floppy disk under the control of the floppy disk controller 3*s*, and the supervisor 3*k* allows the audio signal generator 3*u* to reproduce sounds from the data codes read out from the floppy disk. Therefore, a music can be reproduced in a timbre of another musical instrument such as, for example, a pipeorgan, a harpsichord or a wind musical instrument.

The supervisor 3*k* may format the detecting signals DT1 of the key sensors 2*b* and the detecting signals DT2 of the pedal sensors 2*c* in accordance with the MIDI standards, and the MIDI codes are stored in a floppy disk under the control of the floppy disk controller 3*s*. If the keyboard instrument can record and reproduce a performance, the keyboard instrument has four modes of operation, i.e., the acoustic sound mode, the electronic sound mode, a recording mode and a playback mode.

Figure 4A:
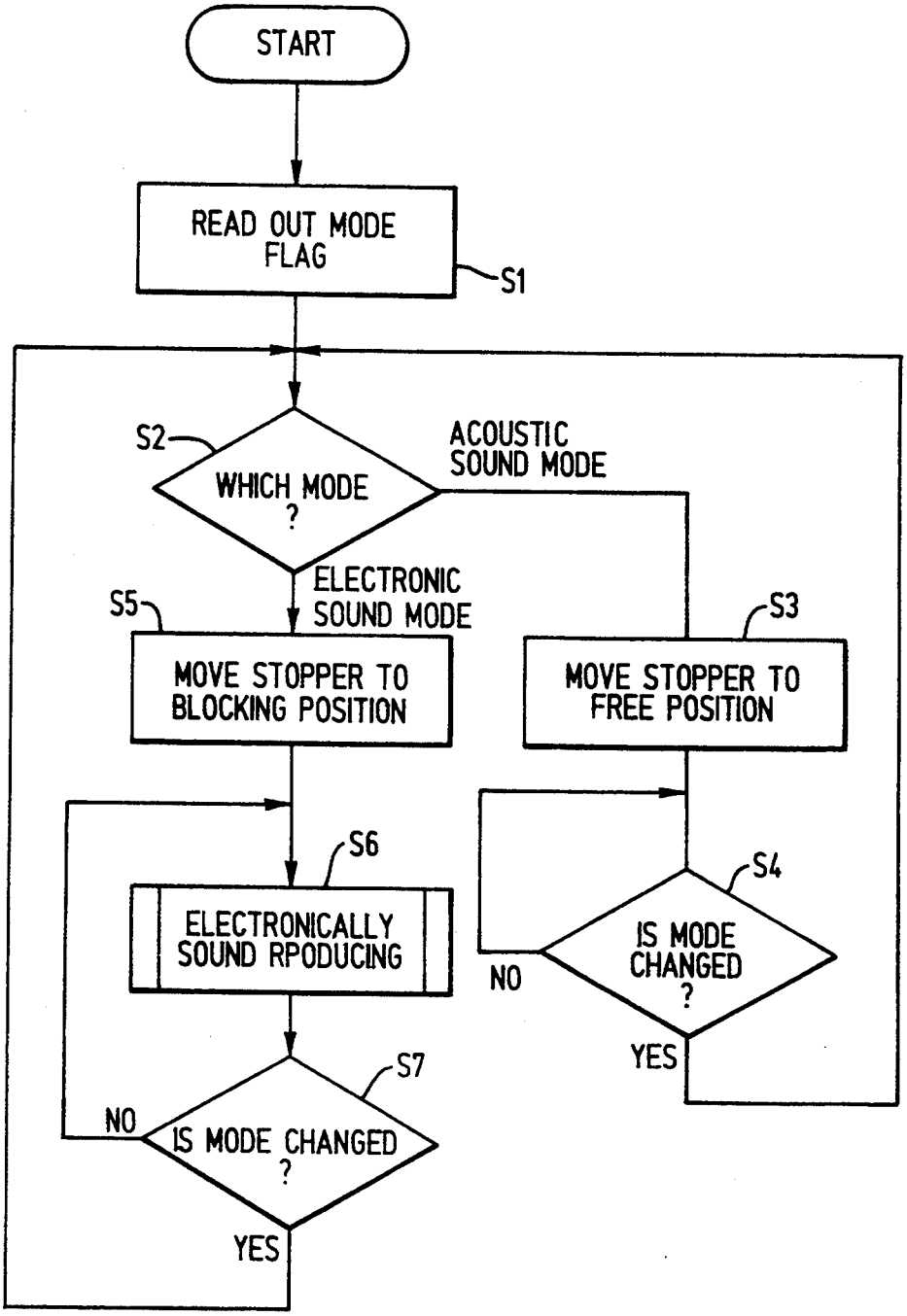
FIGS. 4A and 4B are flow charts showing program sequences executed by the controller.

Description is hereinbelow made on behaviors in the acoustic and electronic sound modes with reference to FIGS. 4A and 4B. When the controller 3*a* is powered, the supervisor 3*k* initializes the controller 3*a*, and, thereafter, the supervisor 3*k* reads out the mode flag from the internal register: as by step S1. The supervisor 3*k* checks the mode flag to see whether the player instructs the acoustic sound mode or the electronic sound mode as by step S2. If the player has instructed the acoustic sound mode through the mode shift switch 2*a*, the supervisor 3*k* proceeds to step 3, and instructs the motor driver 2*b* to move the stopper 2*c* to the free position FP. As a result, the side surface of the first cushion member 2*e* is directed to the hammer shanks I t at home positions, and the stopper 2*c* allows the hammers 1*u* to strike the associated strings 1*d* without any interruption of the stopper 2*c*. Since the other side surface of the first cushion member 2*e* is covered with the second cushion member 2*f*, the damper wires 1*x* are engageable with the second cushion member 2*f*.

Assuming now that a player starts to perform a music on the keyboard 1*a*, he or she selectively depresses the black and white keys 1g, and the capstan screw 1i on each depressed key 1g pushes up the associated whippen assembly 1j, and the whippen assembly 1j and the jack 1k turn in the clockwise direction around the whippen flange 1n without changing the relative position therebetween. The jack 1k rotates the butt 1s in the clockwise direction around the butt flange, and the toe 1k' approaches the regulating button 1q.

The whippen assembly 1j thus rotated causes the damper spoon 1v to decline toward the strings 1d, and the damper spoon 1v pushes the damper lever 1w. The damper lever 1w is, then, driven for rotation in the counter clockwise direction around the damper flange against the elastic force of the damper spring 1z. The damper head 1y coupled with the damper lever 1w through the damper wire 1x is left from the associated set of strings 1d, and allows the strings 1d to vibrate.

When the toe 1k' is brought into contact with the regulating button 1q, the jack is rotated in the counter clockwise direction around the jack flange 1m against the elastic force of the jack spring 1p, and, finally, escapes from the butt 1s. The escape of the jack 1s gives the piano key-touch to the player, and causes the hammer 1u to rush toward the associated set of strings 1d. The hammer 1u strikes the associated set of strings 1d without an interruption of the stopper 2c, and the strings 1d vibrate for producing an acoustic tone as similar to an acoustic upright piano. The hammer 1u rebounds on the strings 1d, and returns to the home position thereof.

As described hereinbefore, the second cushion member 2f receives the damper wires 1x instead of a damper stop rail. Even through the damper wire 1x strikes the stopper 2c, the second cushion member 2f takes up the impact, and a noise at the impact is faint. Therefore, a pianissimo tone can drawn the noise, and the player does not notice the noise. Moreover, the second cushion member 2f prevents the shaft 2d from the impact of the damper wire 1x, and the center axis of the shaft 2d is never misaligned.

While the keyboard instrument is staying in the acoustic sound mode, the supervisor 3k periodically checks the input port assigned to the instruction signal MODE to see whether or not the player changes the mode from the acoustic sound mode to, the electric sound mode as by step S4. If the answer to step S4 is given negative, the supervisor 3k repeats step S4, and the player continues to perform the music with the acoustic sounds.

However, if the player manipulates the mode shift switch 2a for changing to the electronic sound mode, the answer to step S4 is given positive, and the supervisor 3k returns to step S2. Since the answer to step S2 is indicative of the electronic sound mode, the supervisor 3k rewrites the mode flag, and the supervisor 3k instructs the motor driver 2b to change the stopper 2c to the blocking position BP as by step S5. Then, the first cushion member 2e is directed to the hammer shanks 1t, and the second cushion member 2f is still opposed to the damper wires 1x.

The player is assumed to start a music in the electronic sound mode. The player is selectively depressing the block and white keys 1g, and the key action/damper mechanisms 1b associated with the depressed keys 1g behave as similar to the acoustic sound mode. For this reason, the player feels the piano key-touch usual.

The hammer shanks 1t rebound on the first cushion member 2e before the hammers 1u reach the strings 1d. The first cushion member 2e is thick enough to damp the impact, and the protective layer 2h does not allow the hammer shanks It to break the soft cushion layer 2g. The damper spoon 1v also pushes the damper lever 1w, and the damper wire 1x strikes the stopper 2c. However, the impact is taken up by the second cushion member 2f, and the faint noise is drowned by the synthetic sounds produced as described hereinbelow.

While the player is performing the music, the hammer shanks I t repeatedly rebound on the first cushion member 2e, and the stopper 2c tends to vibrate. However, the second cushion member 2f damps the vibrations, and keeps the protective layer 2h stationary. For this reason, the rebounding point of the hammer shanks It is not changed, and the keyboard instrument is responsive to quick fingerings such as a trill.

If the gap between the toe 1k' and the regulating button 1q is changeable depending upon the mode of operation, the escaping point is appropriately readjusted in such a manner that the jacks 1k surely escape from the butt 1s before the contact with the stopper 3c.

While the player is performing the music, the key sensors 3b and the pedal sensors 3c monitor the keys 1g and the pedals, and supply the detecting signals DT1 indicative of the key motions and the detecting signals DT2 indicative of the pedal positions. Using the detecting signals DT1 and DT2, the controller 3a electronically synthesizes sounds through an electronically sound producing sub-routine S6 (see FIG. 4A) in cooperation with the speaker system 3d or the headphone 3h. If the player hears the sounds with the headphone 3h, the synthetic sounds do not disturb the neighborhood.

Figure 4B:
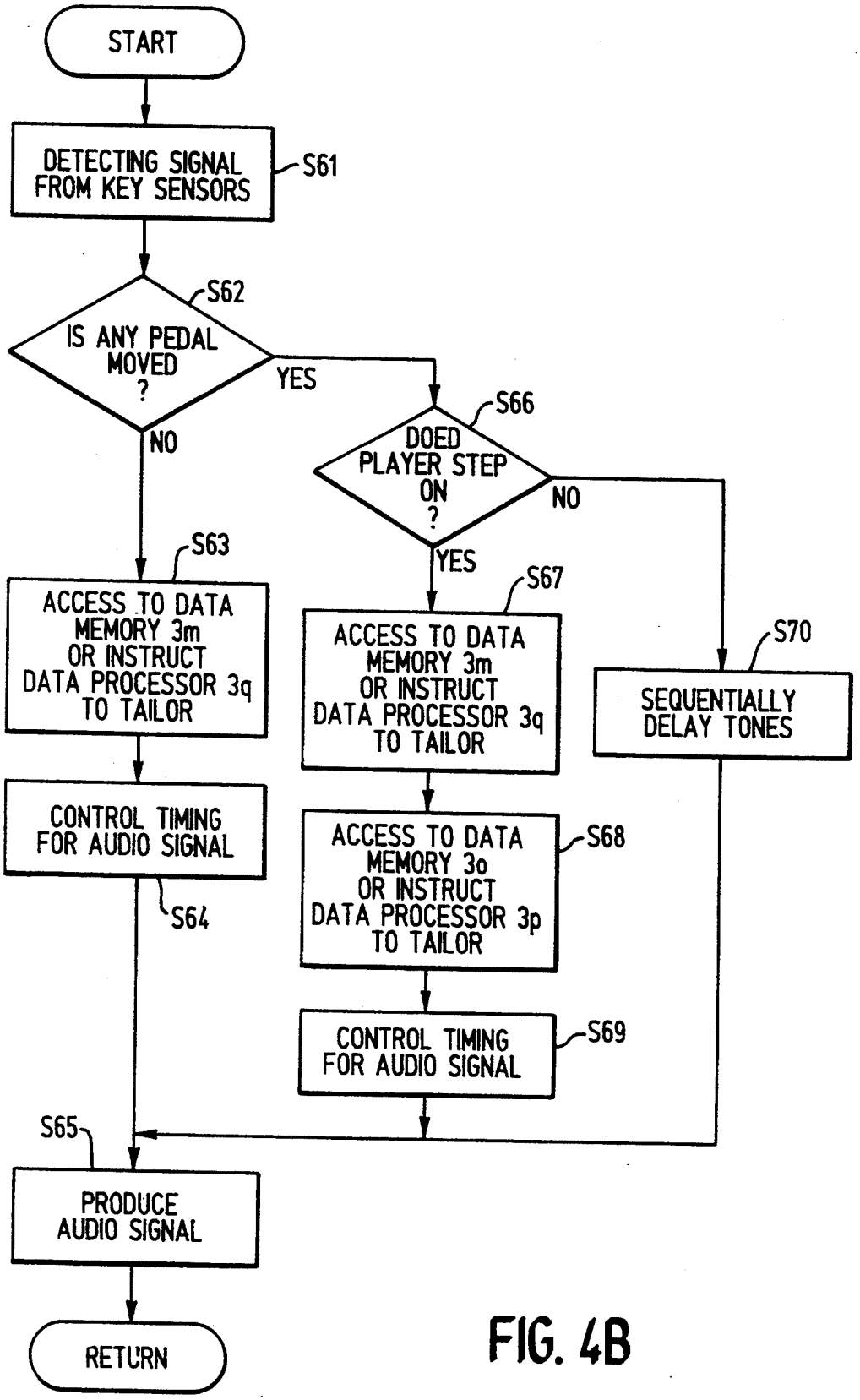
Figure 5:
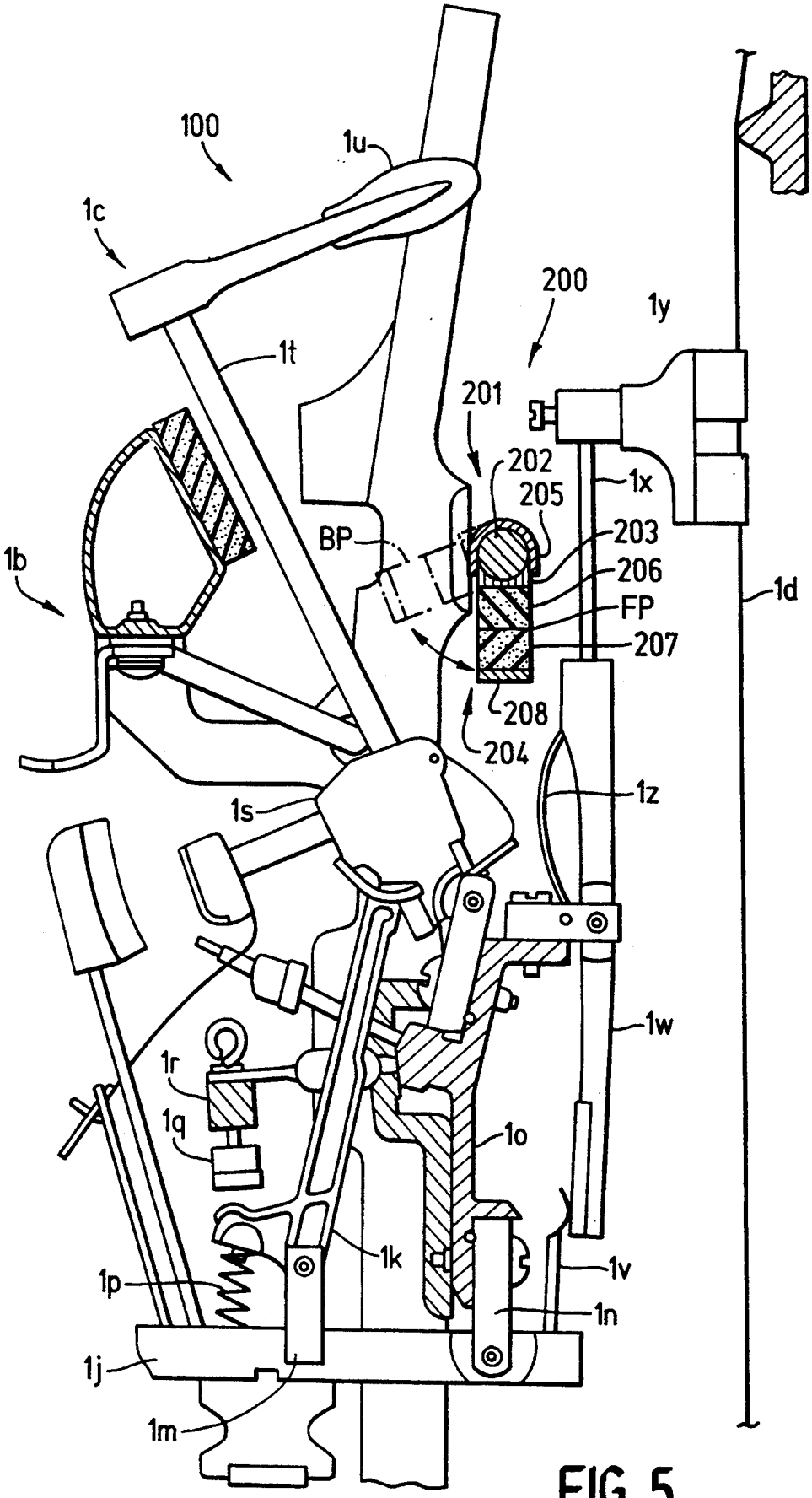
FIG. 5 is a cross sectional side view showing essential parts of another keyboard instrument according to the present invention.

FIG. 4B illustrates the electronically sound producing sub-routine. Upon entry of the electronically sound producing sub-routine S6, the supervisor 3k monitors the input port assigned to the detecting signals DT1, and fetches the detecting signal DT1 as by step S61, if any. After the receipt of the detecting signal DT1, the supervisor 3k identifies the depressed key, and determines the key velocity and the locus of the depressed key 1g on the basis of the detecting signal DT1. The supervisor 3k further estimates the intensity of impact on the basis of the locus of the depressed key 1g. The supervisor 3k further checks the input port assigned to the detecting signals DT2 to see whether or not the player steps on one of the pedals as by step S62.

If the answer to the step S62 is given negative, the supervisor 3k accesses one of the groups of pcm data codes associated with the depressed key in the data memory 3m or instructs the data processor 3q to tailor a group of pcm data codes for the depressed key.

The supervisor 3k accesses the internal table thereof, and determines appropriate timing for producing the audio signal AD as by step S64. The supervisor 3k waits for the appropriate timing, and supplies the group of pcm data codes to the audio signal generator 3u for producing the audio signal AD as by step S65. Then, the audio signal AD is amplified by the amplifier 3w, and the speaker system 3e or the headphone 3h produces a synthetic sound corresponding to the depressed key. After the step S65, the supervisor 3k returns to the program sequence shown in FIG. 4A, and proceeds to step S7.

However, if the player steps on one of the pedal such as the damper pedal 1e' the answer to step S62 is given positive, and the supervisor 3k checks the detecting signals DT2 indicative of the positions of the pedals to see whether the damper pedal 1e' is pushed down or is released as by step S66. If the player steps on the damper pedal 1e', the answer to the step S66 is given positive, and the supervisor 3k firstly accesses the pcm data codes in the data memory 3m or instruct the data processor 3q to tailor the pcm data codes as by step S67. The supervisor 3k further accesses the pcm data codes in the data memory 3o or instructs the data processor 3p to tailor the pcm data codes as by step S68 so as to simulate the resonant vibrations on the related strings. The supervisor 3k controls the timing of the pcm data codes for the original vibrations and the timing of the pcm data codes for the resonant vibrations as by step S69, and time delay is introduced between the timing for the original vibrations and the timing for the resonant vibrations. Upon completion of the step S69, the supervisor 3k proceeds to the step S65, On the other hand, if the pedal is upwardly moved toward the rest position, the answer to step S66 is given negative, and the supervisor 3k instructs the data processor 3q to sequentially decrease the values of the pcm data codes at a selected speed so as to decay the synthetic tone and the resonant tones as by step S70. Then, the supervisor 3k proceeds to the step S65.

Although steps S66 to S70 relate to the damper pedal 1e', other program loops are provided for the other pedals, and impart predetermined effects on the synthetic sounds.

Turning back to FIG. 4A, while the player is performing the music in the electronic sound mode, the supervisor 3k periodically checks the input port assigned to the instruction signal MODE to see whether or not the mode is changed to the acoustic sound mode as by step S7. If the answer to step S7 is given negative, the supervisor 3k returns to the step S6, and reiterates the loop consisting of the steps S6 and S7. However, if the answer to step S7 is given positive, the supervisor 3k returns to the step S2 again.

Thus, the supervisor 3k sequentially executes the loop consisting of the steps S2 to S7, and the player performs the music in either acoustic or electronic sound producing mode.

As will be appreciated from the foregoing description, the keyboard instrument according to the present invention allows the player to perform a music selectively in the acoustic mode and in the electronic sound mode without deterioration of the key-touch, and the second cushion member 2f surely mutes the noise produced at the impact against the stopper 2c in both acoustic and electronic sound modes. In other words, the second cushion member 2f does not allow the noise due to the damper wires 1x to disturb the performance.

Second Embodiment

Turning to FIG. 6 of the drawings, another keyboard instrument embodying present invention comprises an acoustic piano 100, an electronic sound generating system and a mode controlling system 200, and the acoustic piano 100 and the electronic sound generating system are similar to those of the first embodiment. The mode controlling system 200 is further similar to the mode controlling system 2 except for the structure of a shank stopper 201, and, for this reason, description is focused on the shank stopper 201 only for the same of simplicity.

The shank stopper 201 comprises a shaft member 202 formed of the same substance of the shaft member 2d, bracket members 203 of wood or aluminum attached to the shaft member 202 at intervals, a plurality of first cushion members 204 respectively mounted on the bracket members 203 and a second cushion member 205 bonded to the outer peripheral surface of the shaft member 202 180 degrees spaced apart from the bracket members 203. The second cushion member 205 is opposed to the damper wires 1x in both acoustic and electronic sound modes, and may be split into a plurality of submembers.

Each of the first cushion members 204 is implemented by a lamination of a hard cushion layer 206 with large elastic modulus, a soft cushion layer 207 with small elastic modulus and a protective layer 208, and the soft cushion layer 207 is widely deformable rather than the hard cushion layer 206. The protective layer 208 is further different in elastic modulus from the hard and soft cushion layers 206 and 207, and prolongs the service time of the first cushion member 204.

The first cushion members 204 behave similar to the first cushion member 2e, and achieve all of the advantages. Moreover, the laminated structure of the first cushion members 204 is desirable for regulating the elastic property.

Although particular embodiments of the present invention have been shown and described, it will be obvious to those skilled in the art that various changes and modifications may be made without departing from the spirit and scope of the present invention. For example, the stopper 2c may be linked with a nob to be manipulated by a player, and a solenoid-operated actuator is available for the stopper instead of the motor and the motor driver. If the mode controlling system 2 stops the stopper 2c at an appropriate position between between the free position and the blocking position, the hammer shanks may rebound on the stopper 2c concurrently to strikes against the strings, and the stopper 2c muffles the acoustic tones. If the escaping points of the jacks 1k are regulated such that the jacks 1k escape from the butts 1s immediately after the impacts of the hammer shanks against the stopper 2c, the player may feel the key-touch like ground piano. The second cushion member 2f may be available for a keyboard instrument with a grand piano.

What is claimed is:

1. A keyboard instrument having at least an acoustic sound mode for producing acoustic sounds and an electronic sound mode for producing synthetic sounds, comprising:

a) an acoustic piano having a-1) a keyboard implemented by a plurality of swingable keys depressed by a player in both acoustic sound and electronic sound modes, notes of a scale being assigned to said plurality of swingable keys, a-2) a plurality of key action mechanisms respectively linked with said plurality of swingable keys, and selectively actuated by depressed keys of said keyboard in both acoustic sound and electronic sound modes, a-3) a plurality of hammer assemblies respectively associated with said plurality of key action mechanisms, and selectively driven for rotation by actuated key action mechanisms linked with said depressed keys in both acoustic sound and electronic sound modes, said actuated key action mechanisms and the associated hammer assemblies producing a piano key-touch in both acoustic sound and electronic sound modes, a-4) a plurality of string means respectively associated with said plurality of hammer assemblies, and selectively struck by hammer assemblies driven by said actuated key action mechanisms in said acoustic sound mode for producing said acoustic sounds, and a-5) a plurality of damper mechanisms respectively associated with said plurality of string means for damping vibrations thereon, and driven by said depressed keys for leaving from the associated string means, thereby allowing the associated string means to vibrate;

b) an electronic sound generating system enabled in said electronic sound mode for producing said synthetic sounds having notes identified by said depressed keys; and c) a mode controlling system having c-1) a rotatable stopper means provided between said plurality of key action mechanisms and said plurality of string means, and angularly movable between a blocking position and a free position, c-2) a driving means associated with said rotatable stopper means for changing said stopper means between said free position and said blocking position, said hammer assemblies striking said string means without an interruption of said stopper means in said free position, said hammer assemblies being brought into contact with said stopper means in said blocking position without a strike against said string means, and c-3) a cushion means provided on said rotatable stopper means, and opposite to said plurality of damper mechanisms in both acoustic and electronic sound modes, thereby decreasing impact of damper mechanisms associated with said depressed keys against said rotatable stopper means.

2. The keyboard instrument as set forth in claim 1, in which said acoustic piano is an upright piano.

3. The keyboard instrument as set forth in claim 2, in which said rotatable stopper has a shaft member connected with said driving means and driven for rotation over a predetermined angle and a first cushion member attached to a first outer peripheral surface of said shaft member for absorbing impacts of said hammer assemblies.

4. The keyboard instrument as set forth in claim 3, in which said first cushion member is implemented by a plurality of laminated layers different in elastic modulus.

5. The keyboard instrument as set forth in claim 4, in which said plurality of laminated layers has a protective layer exposed to said hammer assemblies for preventing other layers of said plurality of laminated layers from a breakage.

6. The keyboard instrument as set forth in claim 5, in which said cushion means is attached to said rotatable stopper in such a manner as to extend from a side surface of said plurality of laminated layers to a second outer surface of said shaft member on a reverse side of said first outer surface.

7. The keyboard instrument as set forth in claim 5, in which said cushion means is attached to a second outer peripheral surface of said shaft member on a reverse side of said first outer peripheral surface.

8. The keyboard instrument as set forth in claim 2, in which said cushion means on said rotatable stopper means serves as a damper step rail of said upright piano.

* * * * *